US005909900A

United States Patent [19]

Fujiwara

[11] Patent Number: 5,909,900

[45] Date of Patent: Jun. 8, 1999

[54] MENSTRUATION RECORDING DEVICE

[76] Inventor: Shiomi Fujiwara, 11-12, Noke 1-chome, Setagaya-ku, Tokyo, Japan

[21] Appl. No.: 08/950,261

[22] Filed: Oct. 14, 1997

[30] Foreign Application Priority Data

Dec. 27, 1996 [JP] Japan ..... 8-349640

[51] Int. Cl.[6] ..... B42D 15/00

[52] U.S. Cl. ..... 283/115; 283/2; 283/66.1

[58] Field of Search ..... 283/2, 44, 61, 283/66.1, 115; 281/2, 3.1, 5

[56] References Cited

U.S. PATENT DOCUMENTS

| | | | |
|---|---|---|---|
| 5,261,702 | 11/1993 | Mayfield | 283/115 |
| 5,636,870 | 6/1997 | Enhorining | 283/115 X |
| 5,720,502 | 2/1998 | Cain | 283/115 |
| 5,810,395 | 9/1998 | Morgan | 283/115 X |

FOREIGN PATENT DOCUMENTS

| | | |
|---|---|---|
| 8-197863 | 7/1926 | Japan . |
| 5-39695 | 3/1992 | Japan . |

*Primary Examiner*—Willmon Fridie, Jr.
*Attorney, Agent, or Firm*—Venable; Robert J. Frank

[57] ABSTRACT

The present invention provides a menstruation recording device, which can be used every month in the year, for easy recording of an individual menstruation visually or tactually, and is convenient and portable. A menstruation recording device of the present invention comprises a spreadable notebook, a plurality of date indicating portions comprising loop side fastener materials, arranged around the spread surfaces, which can be used in every month of the year, at least two sets of marker supporting portions comprising loop side fastener materials, provided separately from the plurality of the date indicating portions, at least two sets and four kinds of markers to be arranged removably on the date indicating portions or the two sets of the marker supporting portions for arranged on the two sets of the marker supporting portions not in use, and on dates of the date indicating portions corresponding to the current menstruation date and the menstruation finishing date, and the next menstruation date and the next menstruation finishing date in use.

9 Claims, 6 Drawing Sheets

4A, 4a, 5B, 5b: MARKER
6A, 6B, : MARKER SUPPORTING PORTION

MENSTRUATION RECORDING DEVICE

BACKGROUND OF THE INVENTION

1. Field of the Invention

The present invention relates to a menstruation recording device for recording menstruation visually or tactually, more specifically, to a menstruation recording device for recording a menstruation starting date, a menstruation period, a menstruation cycle, a life period of an ovum, an ovulation date, and the next menstruation date, conveniently.

2. Description of the Related Art

It is essential for a woman to record the information on her menstruation and predict the next menstruation date and ovulation date based on a cycle inherent to her in order to lead a comfortable life.

The present inventor has proposed sanitary shorts comprising, shorts with dates for one month printed thereon so as to be used for every month in the year, and a removable marker for marking a menstruation starting date on the corresponding date printed on the shorts in Japanese Examined Utility Model Publication No. 5-39695.

Further, the present inventor has advocated sanitary shorts, comprising two markers for indicating the current menstruation starting date and the next menstruation starting date on date indicating portions so that a menstruation cycle and subsequent menstruation dates can be easily predicted in Japanese Patent Application No. 8-197863.

The above-mentioned sanitary shorts have the advantage of calling the wearer's attention to her menstrual cycle when putting them on or taking them off, since the sanitary information inherently necessary to the individual is recorded on a garment necessary for daily life.

However, the shorts have disadvantages for being a garment, such as durability in washing with the markers attached, wearing discomfort, the necessity of a plurality of the shorts in consideration of frequency of the use, and limited accessibility to the information in ordinary daily life situations, in a room or on outing due to the difficulty of looking at the sanitary shorts in order to confirm the next menstruation starting date in such circumstances. Therefore, an alternative product which is convenient for placing at an easily-accessible place or for portable use has been desired.

SUMMARY OF THE INVENTION

Accordingly, in order to solve the above-mentioned problems of the prior art, an object of the present invention is to provide a menstruation recording device, comprising a spreadable notebook, a board, or a card instead of the conventional sanitary shorts, for recording menstruation visually or tactually that is convenient and portable.

The menstruation recording device of the present invention comprises a spreadable notebook, a plurality of date indicating portions arranged around the spread surfaces, which can be used in every month of the year, at least two sets of marker supporting portions provided separately from the plurality of the date indicating portions, and at least two sets and four kinds of removable markers to be arranged on the date indicating portions or the two sets of the marker supporting portions. The two sets and four kinds of removable markers are arranged on the two sets of the marker supporting portions not in use, and on dates of the date indicating portions corresponding to the current menstruation date and the ovulation date preceding the current menstruation date or the menstruation finishing date, and the next menstruation date and the ovulation date preceding the next menstruation date or the next menstruation finishing date in use.

In this case, the spreadable notebook can be replaced by a board or a card.

The plurality of the date indicating portions, at least two sets of the marker supporting portions, at least two sets and four kinds of the markers can comprise a Hook-and-Loop fastener, or at least two sets and four kinds of the markers can comprise an adhesive tag.

DESCRIPTION OF THE PREFERRED EMBODIMENTS

Hereinafter embodiments of the present invention will be described with reference to drawings.

Figure 1:
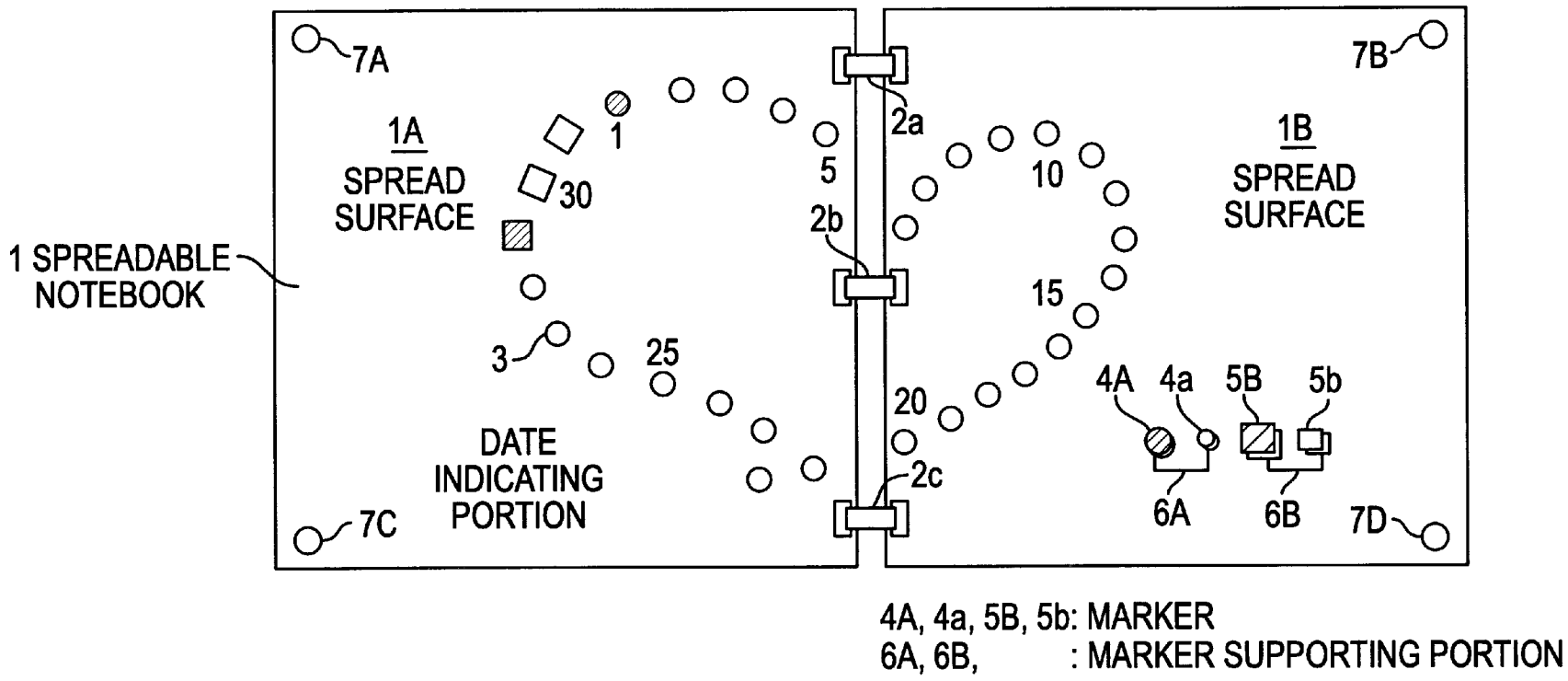
FIG. 1 is a plan view of a first embodiment of a menstruation recording device of the present invention, comprising a spreadable notebook.

FIG. 1 is a plan view of a menstruation recording device of a first embodiment of the present invention, comprising a spreadable notebook 1.

The notebook 1 comprises fastening portions 2*a,* 2*b,* 2*c* for binding spread surfaces 1A and 1B in a manner that allows the notebook to be spread open.

31 pieces of date indicating portions 3 for indicating dates of a month, are arranged substantially around on the spread surfaces 1A and 1B.

The 31 pieces of the date indicating portions 3 can be provided in any pattern, which can be used for any month in the year, arranged in substantially a round shape for facilitating cognition of a menstruation cycle, such as a heart shape as illustrated, a fish shape, or a flower shape.

The date indicating portions 3 comprise the loop side fastener materials of a Hook-and-Loop fastener (generally called Velcro tape (trademark)), which comprises loop side fastener materials and hook side fastener materials, provided in a square shape having about 1 cm side or a circle shape having about 1 cm diameter, attached by adhesion or fixation.

The date indicating portions 3 comprising the loop side fastener materials are fixed on the spread surfaces 1A and 1B. Markers 4A, 4*a,* 5B, 5*b* comprising hook side fastener materials in use are attached on the loop side fastener materials of the corresponding date for designating the date.

The markers 4A, 4*a,* 5B, 5*b* comprising the hook side fastener materials not in use are placed on marker supporting portions 6A, 6B comprising loop side fastener materials adhered or fixed on a blank portion outside the 31 pieces of the date indicating portions 3 on the spread surfaces 1A, 1B.

The numerals of the corresponding dates are printed in the vicinity of the 31 pieces of the date indicating portions 3.

The numerals to be printed need not be for the entire 31 days, but for example, numerals for some days for marking, such as 1st, 5th, 10th, 15th, 20th, 25th, 30th would be sufficient. The order of arranging the numerals may either be clockwise or counterclockwise.

The shape of the 31 pieces of the date indicating portions 3 may either be square or circular. In the above-mentioned embodiment, the days for marking, namely, 1st, 5th, 10th, 15th, 20th, 25th, 30th can have a square shape for being distinguished from the other dates having a circular shape.

Or the date indicating portions 3 for 29th, 30th, 31st may have a square shape to call attention to months that do not contain thirty-one days, i.e., February, April, June, September and November.

Although the 31 pieces of the date indicating portions 3 mentioned above have a square shape or a circular shape, by forming the shape of the date indicating portions 3 for the days for marking, such as 1st, 5th, 10th, 15th, 20th, 25th, 30th, or a simplified form thereof with Braille, visually handicapped people can recognize the dates by touching the date indicating portions 3.

The markers 4A, 4*a,* and the markers 5B, 5*b* comprise a pair of large and small hook side fastener materials respectively, and each pair has a different color and a shape, such as red markers and yellow markers. The markers 4A, 4*a,* 5B, 5*b* not in use are placed on the marker supporting portions 6A, 6B comprising loop side fastener materials adhered or fixed on a blank portion outside the 31 pieces of the date indicating portions 3 on the spread surfaces 1A, 1B.

Although the markers 4A, 4*a,* 5B, 5*b* comprise hook side fastener materials and the date indicating portions 3 and the marker supporting portions 6A, 6B comprise loop side fastener materials in the above-mentioned embodiment, the materials used may replace each other.

The usage of the menstruation recording device comprising a spreadable notebook of the above-mentioned configuration will be described below.

For example, in a case where menstruation started on the 1st of a month, the large red marker 4A comprising the hook side fastener material is removed from the marker supporting portion 6A and placed on the date indicating portion 3 corresponding to the 1st on the spread surface 1A of FIG. 1 comprising the loop side fastener material (marked with oblique lines).

If the period of the menstruation was one week, the small red marker 4*a* is removed from the marker supporting portion 6A and placed on the date indicating portion 3 corresponding to the 7th comprising the loop side fastener material.

Accordingly, the menstruation starting date, the menstruation finishing date and the menstruation period were recorded on the date indicating portions 3 with the large red marker 4A and the small red marker 4*a* so that they can be recognized either visually, or in the case of visually-handicapped users, tactually by the shapes of the red marker 4A and the red marker 4*a,* and the dates or simplified forms thereof provided in Braille adjacent to the date indicating portions 3 attached with the markers.

If the subsequent menstruation started on the 29th, the large yellow marker 5B is removed from the marker supporting portion 6B and placed on the date indicating portion 3 corresponding to the 29th comprising the loop side fastener material. If the period of the menstruation was one week, the small yellow marker 5*b* is removed from the marker supporting portion 6B and placed on the date indicating portion 3 corresponding to the 7th day from the 29th (29th inclusive).

The menstruation cycle of the user can be found by counting the dates between the day of the red marker 4A corresponding to the 1st and the day of the yellow marker 5B corresponding to the 29th.

After finding the menstruation cycle at the time of placing the yellow marker 5B on the corresponding date indicating portion 3, the red marker 4A placed on the date indicating portion 3 corresponding to the 1st, which is the previous menstruation starting date, is removed and returned to the marker supporting portion 6A.

Then the next menstruation starting date can be predicted.

Since the menstruation cycle of the user mentioned above, namely the dates between the 1st to the 29th, was 28 days, the "28th" day counted from the 29th (29th inclusive) can be presented as the predicted next menstruation starting date. Accordingly, the red marker 4A placed on the marker supporting portion 6A is removed and placed on the date indicating portion 3 corresponding to the predicted menstruation starting date.

By recognizing the position of the red marker 4A either visually or tactually, the predicted next menstruation starting date can be seen.

In the case the actual menstruation starting date contradicted the predicted menstruation starting date, the preceding menstruation starting date can be predicted by removing the red marker 4A placed on the date indicating portion 3 corresponding to the predicted menstruation starting date, and placing it on the date indicating portion 3 corresponding to the actual menstruation starting date, and counting the menstruation cycle from the actual menstruation starting date to find the preceding menstruation starting date, which is the next day of the last day of the cycle.

Furthermore, the 12 to 16 days before the predicted menstruation starting date can be presented as the ovulation period according to the Ogino theory.

Although the ovulation starting date can be learned by counting the dates backward from a predicted menstruation starting date, it is also possible to prepare another marker in addition to the red markers 4A, 4*a* and the yellow markers 5B, 5*b* for recording the ovulation starting date on the corresponding date indicating portion 3.

Since the plurality of the date indicating portions 3 arranged in substantially a round shape on the spread surfaces can be used for any month in the year, menstruation, such as the menstruation starting date, the menstruation period, the menstruation cycle and the ovulation period can be recognized throughout the year easily for anyone including the visually-handicapped people, by repeating the operation of putting on and taking off the red markers 4A, 4*a* and the yellow markers 5B, 5*b* on the corresponding date indicating portions 3 on the spreadable notebook 1.

The spreadable notebook 1, when not in use, is closed by fastening the loop side fastener materials and the hook side fastener materials 7A, 7B, 7C, 7D provided on each corner of the notebook.

Since the spreadable notebook 1 shown in FIG. 1 can be placed on a table or always kept at hand, the personal menstruation can easily be recognized visually or tactually for anyone including the visually-handicapped people unlike the conventional product comprising shorts with the date indicating portions printed thereon. Further, since the notebook 1 is spreadable, inadvertent exposure to the others can be avoided by closing the notebook not in use.

Although the plurality of the date indicating portions 3 arranged around on the spreadable notebook 1 comprise a heart shape in FIG. 1, the shape is not limited thereto but variety of configurations can be adopted for the date indicating portions 3, such as patterns, landscapes, and colors comfortable or entertaining for a female user.

The spreadable notebook 1 can be bound in ordinary notebooks or pocket notebooks having more than few pages.

Figure 2:
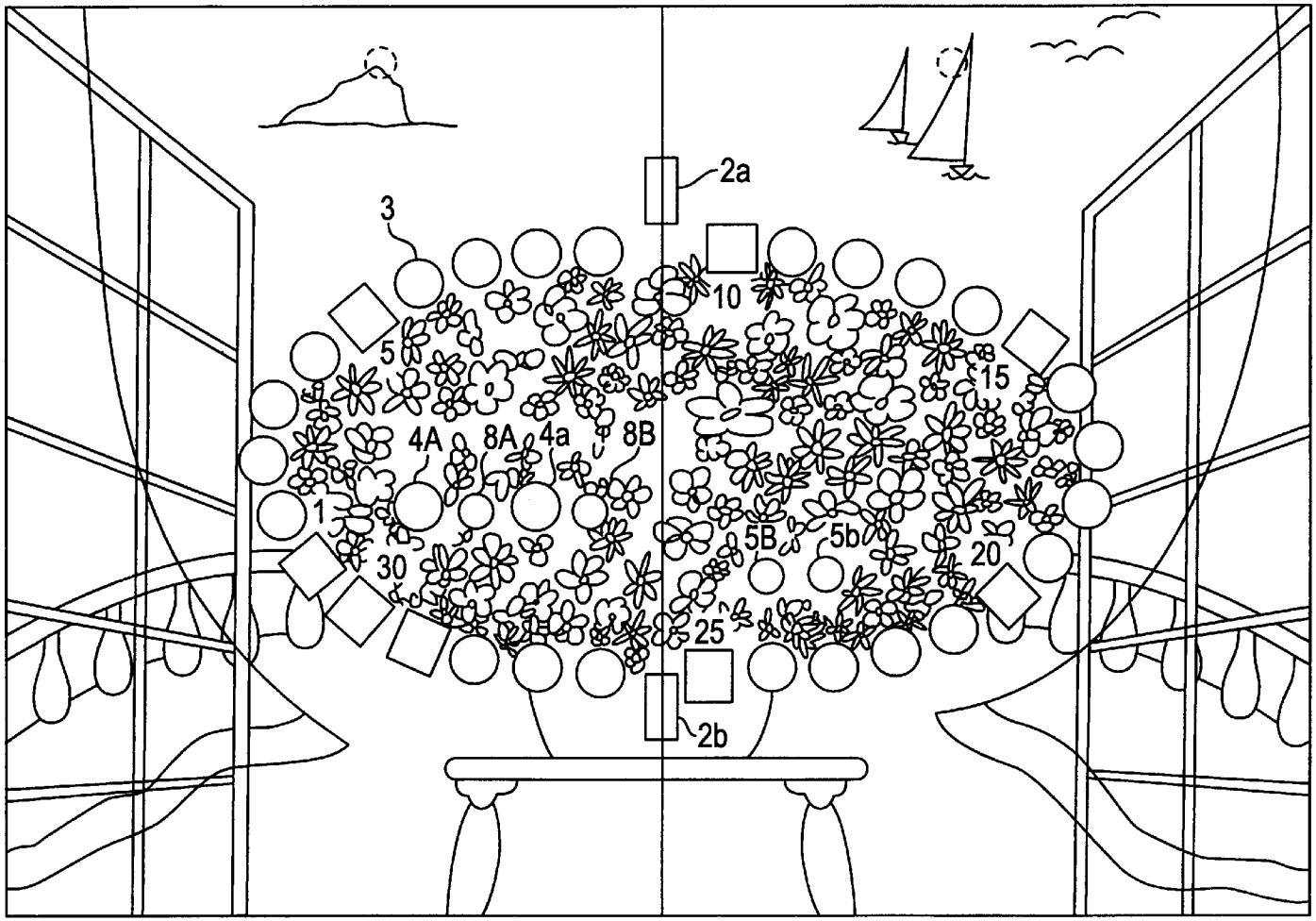
FIG. 2 is a plan view of a second embodiment of a menstruation recording device of the present invention, comprising a spreadable notebook.

In the second embodiment shown in FIG. 2, date indicating portions 3 comprising 31 pieces of loop side fastener materials of a Hook-and-Loop fastener arranged around a picture of flowers on a window overlooking sea.

In the flowers, two sets and four kinds of markers 4A, 4*a*, 5B, 5*b* comprising loop side fastener materials of the Hook-and-Loop fastener, independent from the plurality of the date indicating portions 3 and two sets of marker supporting portions comprising hook side fastener materials corresponding thereto are provided.

By recording and recognizing corresponding dates for a previous menstruation starting date, a previous menstruation finishing date, a current menstruation date and a current menstruation finishing date, a menstruation cycle, a life period of an ovum, an ovulation date shown on the date indicating portions 3 arranged in a round shape by attaching and detaching the two sets of the markers 4A, 4*a*, 5B, 5*b*, individual menstruation can be recorded easily, and comfortably using a beautiful picture, and furthermore, the next menstruation date and the ovulation date can be predicted.

Since the usage of the menstruation recording device comprising the spreadable notebook of the configuration of FIG. 2 by attaching and detaching markers is the same as that of the configuration of FIG. 1, detailed explanation is not provided herein.

Figure 3:
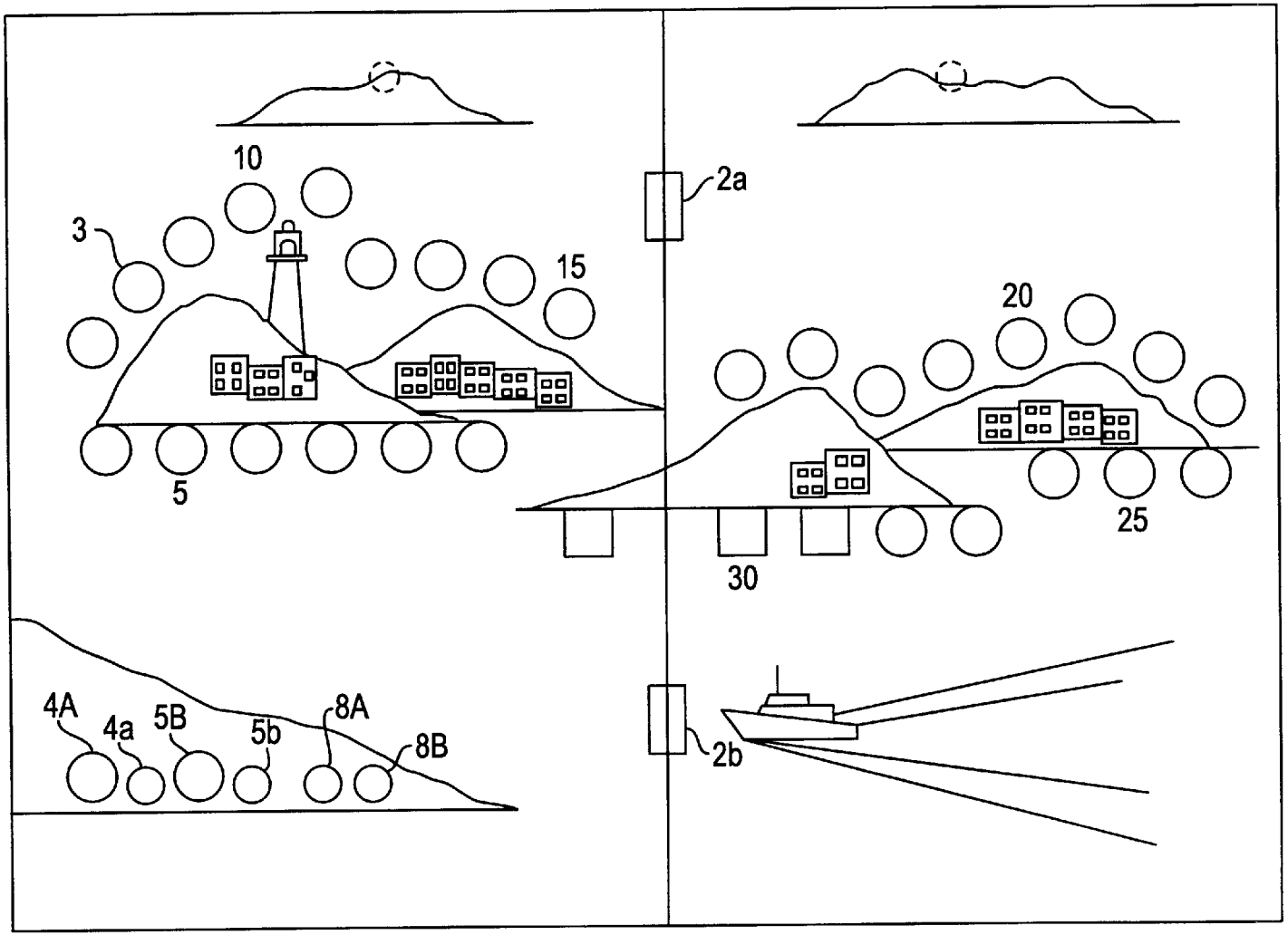
FIG. 3 is a plan view of a third embodiment of a menstruation recording device of the present invention, comprising a spreadable notebook.
Figure 4:
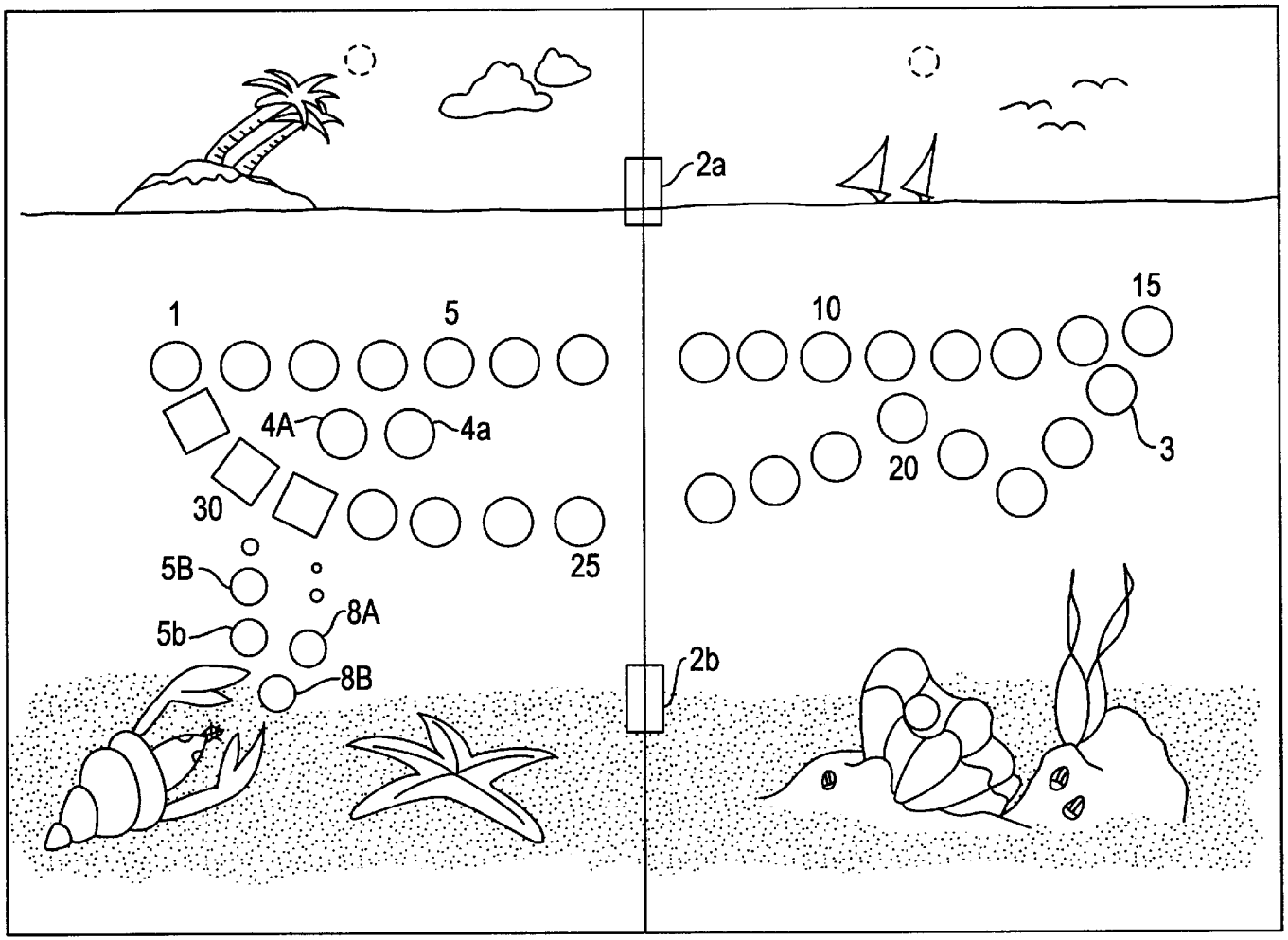
FIG. 4 is a plan view of a fourth embodiment of a menstruation recording device of the present invention, comprising a spreadable notebook.

As examples of various options for the pictures used in the above-mentioned spreadable notebook, such as patterns, landscapes and colors, a third embodiment and a fourth embodiment are shown in FIGS. 3 and 4. Since the configurations comprise date indicating portions 3 in a round shape, two sets and four kinds of markers 4A, 4*a* and 5B, 5*b* comprising loop side fastener materials and hook side fastener materials, and two sets of marker supporting portions corresponding thereto as in the embodiments shown in FIGS. 1 and 2, detailed explanation for the usage is not provided herein.

Figure 5:
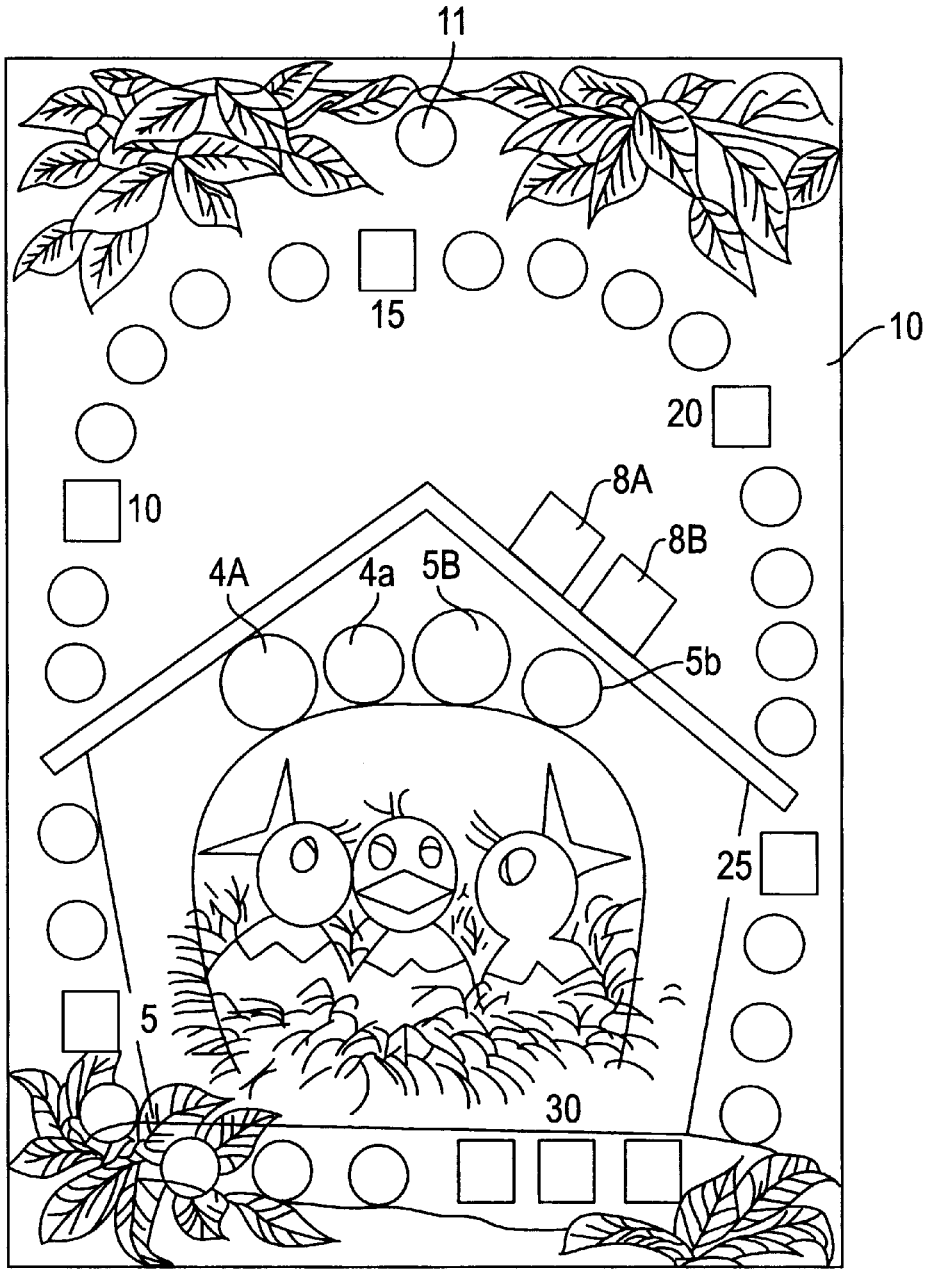
FIG. 5 is a plan view of a fifth embodiment of a menstruation recording device of the present invention, comprising a board to serve as a board.

A fifth embodiment of a menstruation recording device shown in FIG. 5 comprising a board 10, with an optional picture and 31 pieces of the date indicating portions 3 arranged in a round shape, of a substantially 15 cm height and 10 cm width size in place of a spreadable notebook will be explained below.

The markers 4A, 5B for marking the current and next menstruation starting dates, and the markers 8A, 8B for marking the current and next ovulation starting dates are provided outside the date indicating portions 3. The date indicating portions 3 and the markers comprise loop side fastener materials and hook side fastener materials of a Hook-and-Loop fastener as in the embodiments of FIGS. 1 and 2.

Although the markers 8A, 8B for marking the ovulation starting dates are used on the board 10, the markers 4*a*, 5*b* for marking the menstruation periods shown in FIGS. 1 to 4 can be used in place thereof, or in addition thereto.

The board 10 can be placed two-dimensionally on a table, or can be used with a prop for display on a desk. Furthermore, it is also possible to be hanged on a wall by a hanging-hole 11 provided in an upper part of the board.

Figure 6:
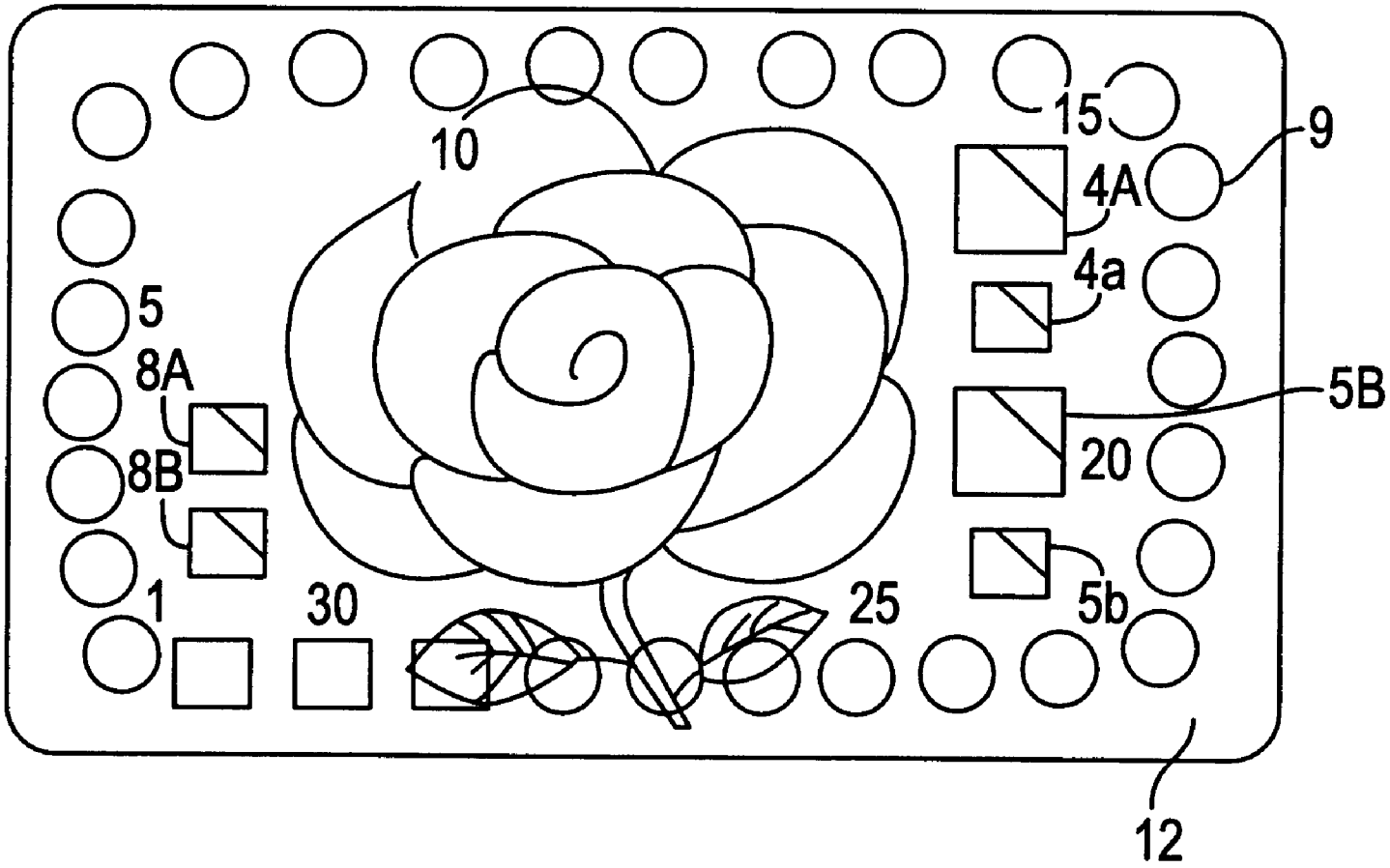
FIG. 6 is a plan view of a sixth embodiment of a menstruation recording device of the present invention, comprising a card.

FIG. 6 shows a sixth embodiment of a menstruation recording device, comprising a card of a size and shape similar to a phone card.

The material of a card 12 is not particularly limited but materials such as plastic, paper, and wood can be used. Date indicating marks 9 of optional shapes such as circle, square, flower, star, etc. are printed on the card surface. The date indicating marks 9 for some days for marking, such as 1st, 5th, 10th, 15th, 20th, 25th, 30th are printed on the card 12.

The markers 4A, 5B for marking the current and next menstruation starting dates, and the markers 8A, 8B for marking the current and next ovulation starting dates are provided outside the date indicating marks 9. The markers comprise adhesive tags with a bent triangle portion without an adhesive to be held at the time of attaching the markers on a corresponding date indicating mark 9.

Since the usage of the markers 4A, 5A and the markers 8A, 8B for marking the ovulation starting dates are the same as the embodiments shown in FIGS. 1 to 5, explanation is not provided herein.

It is preferable to print a note mentioning "The ovulation date of a person with a normal cycle (25 to 38 days) is expected to be a day among 12 to 16 days before the predicted next menstruation starting date (Ogino method). Please use the markers 8A, 8B therefor." on the back side of the card 12 so as to draw the user's attention to their function.

Since the menstruation recording device comprising a card and markers of adhesive tags is thin and convenient for portable use, individual menstruation can be recorded easily.

As the above-mentioned adhesive tags, Post It (trademark) or an adhesive photograph such as Print Club (trademark) can be used.

The present invention provides a menstruation recording device comprising 1 spreadable notebook, a board, or a card, for recording menstruation visually or tactually. Since a menstruation starting date, a menstruation period, a menstruation cycle, a life period of an ovum, an ovulation date, and the next menstruation date are marked with at least two sets of removable markers on a plurality of date indicating portions or date indicating marks arranged in a round shape on the indicating surface, the device can be used for every month of the year, allowing easy recording of the menstruation either visually, or in the case of visually-handicapped users, tactually.

Furthermore, since various kinds of patterns, landscapes, and colors, satisfying for the tastes of the users, can be optionally adopted on the device, a menstruation recording device that is comfortable, convenient and portable can be provided.

What is claimed is:

1. A menstruation recording device comprising:

a spreadable notebook;

a plurality of date indicating portions arranged around the spread surfaces, which can be used in every month of the year;

at least two sets of marker supporting portions provided separately from the plurality of the date indicating portions; and at least two sets and four kinds of removable markers to be arranged on the date indicating portions or the two sets of the marker supporting portions, for arrangement on the two sets of the marker supporting portions not in use, and on dates of the date indicating portions corresponding to the current menstruation date and the ovulation date preceding the current menstruation date or the menstruation finishing date, and the next menstruation date and the ovulation date preceding the next menstruation date or the next menstruation finishing date in use.

2. The menstruation recording device according to claim 1, comprising a board instead of the spreadable notebook.

3. The menstruation recording device according to claim 1, comprising a card instead of the spreadable notebook.

4. The menstruation recording device according to claim 1, wherein the plurality of the date indicating portions, at least two sets of the marker supporting portions, and at least two sets and four kinds of the markers comprise a Hook-and-Loop fastener.

5. The menstruation recording device according to claim 1, wherein at least two sets and four kinds of the markers comprise an adhesive tag.

6. The menstruation recording device according to claim 2, wherein the plurality of the date indicating portions, at least two sets of the marker supporting portions, and at least two sets and four kinds of the markers comprise a Hook-and-Loop fastener.

7. The menstruation recording device according to claim 3, wherein the plurality of the date indicating portions, at least two sets of the marker supporting portions, and at least two sets and four kinds of the markers comprise a Hook-and-Loop fastener.

8. The menstruation recording device according to claim 2, wherein at least two sets and four kinds of the markers comprise an adhesive tag.

9. The menstruation recording device according to claim 3, wherein at least two sets and four kinds of the markers comprise an adhesive tag.

* * * * *